United States Patent [19]

Wallin

[11] Patent Number: 4,620,398

[45] Date of Patent: Nov. 4, 1986

[54] ARRANGEMENT IN BUILDING STRUCTURES INCORPORATING A FOUNDATION MAT, FOR CREATING A VOLUME OF AIR BENEATH THE MAT

[76] Inventor: Veikko Wallin, Sommarvägen 3., 175 40 Järfälla, Sweden

[21] Appl. No.: 676,302

[22] Filed: Nov. 29, 1984

[30] Foreign Application Priority Data

Dec. 15, 1983 [SE] Sweden ..... 8306971
May 29, 1984 [SE] Sweden ..... 8402891

[51] Int. Cl.[4] ..... E02D 27/00
[52] U.S. Cl. ..... 52/169.1; 52/169.11; 405/131
[58] Field of Search ..... 52/169.1, 169.14, 169.11, 52/169.5, 303; 98/31, 32, 33 A, 33 R, 40 C, 42 R; 405/131

[56] References Cited

U.S. PATENT DOCUMENTS 2,332,227 10/1943 Jackson ..... 405/131
2,584,573 2/1952 Gay ..... 52/169.14 X
3,791,443 2/1974 Burt et al. ..... 405/229 X

FOREIGN PATENT DOCUMENTS 7410228 7/1977 Sweden ..... 52/169.5

*Primary Examiner*—Carl D. Friedman
*Attorney, Agent, or Firm*—Burns, Doane, Swecker & Mathis

[57] ABSTRACT

An arrangement in building structures (1) having a support mat (2) for creating beneath the support mat (2) an air mass or volume (3'). A fan or like device is provided for supplying air under overpressure to a bed located beneath the support mat. Arranged in the bed (3) beneath the mat (2) are hoses (9) and/or pipes, which are connected to the fan (7).

14 Claims, 4 Drawing Figures

ARRANGEMENT IN BUILDING STRUCTURES INCORPORATING A FOUNDATION MAT, FOR CREATING A VOLUME OF AIR BENEATH THE MAT

TECHNICAL FIELD

The present invention relates to an arrangement in building structures incorporating a foundation mat, for creating or forming a volume of air beneath the mat.

BACKGROUND ART

It is known to provide building foundations, by constructing a complete concrete mat upon a supporting bed or drainage stratum. The use of whole concrete mats in the construction of building foundations has been put into practice both in the erection of small dwelling houses and in the erection of large storage buildings, retail houses, departmental stores and like structures.

It is well known to those skilled in this art that from the aspect of constructional engineering a building foundation which incorporates a whole mat or a multi-sectional mat is a simple structure easily achieved.

Experience has shown, however, that such foundation mats normally give rise to cold flooring, and that large quantities of moisture are liable to collect within the flooring structures. The presence of this moisture has resulted in floor coverings bonded to the mat loosening therefrom.

Those problems associated with building foundations which incorporate such mats have consequently necessitated the application of other, far more expensive solutions.

The provision of balanced ventilation in connection with so-called cottage lots using fan means herefor also forms part of the prior art. In this case, hot air is forcibly passed between the surface of the ground and a floor structure, to replace existing air, in order to heat the floor structure.

DISCLOSURE OF THE INVENTION

Technical Problem

When considering the present state of the art it will be seen that a particularly qualified technical problem in this respect is one of recommending measures and of providing simple means with which foundation structures incorporating concrete mats, for small dwelling houses for example, can be produced while eliminating, or substantially eliminating, the problem of cold flooring.

It will also be seen that a further qualified technical problem in the construction of foundation structures incorporating mats, irrespective of whether the foundation is for small domestic dwelling houses or for large building complexes, is one of providing ways and means of reducing the presence of moisture in flooring structures, such as to produce subsequently a flooring structure which exhibits moisture-free characteristics.

A still more qualified technical problem in respect of building foundations which incorporate a concrete mat and which are intended for either the erection of small dwellings or of large buildings, is one of providing simple means which enable the removal of a large part of the moisture present in the floor structure, such that subsequently the moisture content of the floor structure is so low that said structure exhibits moisture-free characteristics.

A further problem, and one which requires a qualified understanding of the problems on hand, is that of providing ways by which the aforesaid problems associated with mat foundation structures can be eliminated, already in the erection of new structures.

Another problem of a highly qualified technical nature is one of providing ways with which the aforesaid technical problems associated with existing mat foundation structures for the erection of small dwelling houses can be eliminated. This also applies, of course, to a large extent in the case of large existing buildings in which excessive moisture in the flooring structures thereof present problems, with respect to holding the floor coverings bonded to respective concrete floor tiles.

When considering the aforementioned technical problems associated with high moisture contents of the supporting mats, a further problem of a highly technical nature, whether in connection with buildings under construction or with existing, well established buildings, is one of employing means for preventing harmful gases rising from beneath the ground surface from entering the building.

This includes means for expelling radon gases and daughter gases from the interiors of buildings, or preventing such gases from entering therein.

A further qualified technical problem is one of providing ways and means with which the moisture content of a mat can be restricted in combination with the expulsion of radon gas and/or other gas, particularly obnoxious gases, such as to prevent such gases from entering the building.

A further problem in the present context is one of reducing or eliminating heat losses through the flooring, while utilizing to this end surplus heat obtained, for example, from the evacuation air.

Still a further qualified technical problem in this regard in the building of mat foundations in buildings under construction is one of reducing, and in certain cases eliminating the need of thermal insulation in the flooring, without creating conditions for a cold floor and instigating problems relating to high quantities of moisture in the floor structure.

Experience shows that unless counter measures are taken a concrete mat will have a relative degree of wetness of practically 100%, and that the task of reducing this wetness to 90% or slightly therebeneath represents a serious technical problem. It is still more problematic to reduce this degree of wetness still further, for example down to about 60%.

Solution

The present invention relates to an arrangement for providing in building structures incorporating a foundation mat a volume of air beneath said mat.

In accordance with the invention air under overpressure is arranged to be supplied, via a fan or like device, to the bed located beneath the mat. Air under overpressure is supplied to a drainage stratum beneath the mat.

The fan is suitably arranged to co-act with a speed regulator, so as to enable one and the same fan arrangement to be used in differing ground conditions and to be adapted to a pre-determined overpressure.

The possibility is provided of introducing into the bed located beneath the mat hoses and/or pipes connected to the fan means, and of providing in the bed a plurality of air ejection locations. It is also proposed that passages which are totally or partially perforated are arranged in the bed.

In accordance with one advantageous embodiment of the invention, the bed on which the mat rests has an air permeability which will enable pressure to be distributed with but small losses.

Conveniently, there is selected an overpressure in the bed which ensures that an overpressure will prevail irrespective of climatic conditions.

Pipes and/or hoses coupled to the fan means, particularly in respect of existing buildings, may be arranged totally within the building and/or in the floor structure, and the air ejection locations can then pass solely through the floor structure.

In accordance with another advantageous embodiment of the invention, heated air is passed to the bed, it being particularly suitable to this end to use the air evacuated from the interior of the building.

In the case of existing buildings it is proposed that a hole is formed in the mat and that a fan is connected to the hole.

Conveniently, part of the air introduced into the ground is evacuated, particularly in the case of large building complexes.

Advantages

Those advantages which can be considered particularly characteristic of an arrangement according to the invention reside in the possibility of providing a warm floor surface facing a foundation mat with the aid of simple means and without restricting the thermal insulation of the floor, or in conjunction with the restriction of thermal floor insulation, while, at the same time, providing ways and means of removing moisture from the floor structure and preventing gases from entering the building.

The arrangement according to the present invention is mainly characterized by the features set forth in the characterizing clause of the following claim 1.

BRIEF DESCRIPTION OF THE DRAWINGS

The invention will now be described with reference to an embodiment thereof illustrated in the accompanying drawings, the illustrated embodiment being that at present preferred, in which drawings

DESCRIPTION OF EMBODIMENTS AT PRESENT PREFERRED

Figure 1:
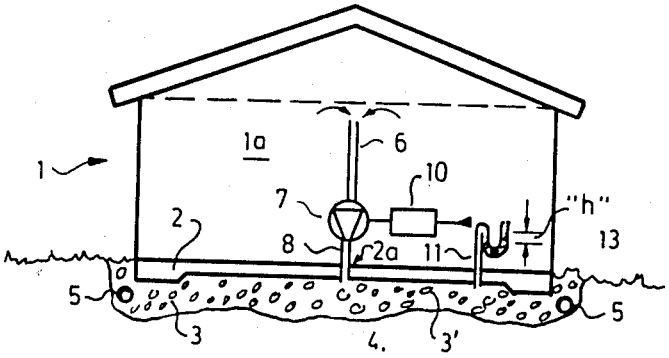
FIG. 1 is a sectional view of an existing small house dwelling incorporating the proposals made in accordance with the present invention.

Referring to FIG. 1, there is illustrated highly schematically an arrangement for providing a volume of pressurized air beneath the support mat of an existing building whose foundations include such a mat, or for pressurizing the volume of air already present beneath said mat. The technical effect afforded by such a volume of air under pressure is one of reducing the moisture content of the mat and the bed upon which it seats. It has also been found that such a volume of pressurized air will prevent gases from passing from the ground into the overlying building.

The provision beneath the mat of a pressurized volume of air will, in itself, cause air to migrate from said volume of air out to atmosphere, this air migration contributing towards slow ventilation. In order to sustain the overpressure, it is necessary to supply additional air to said air volume or air mass. The amount of additional air required and the necessary pressure thereof depends upon the nature of the ground and of the bed.

In FIG. 1, the building is identified by the reference 1 and rests on a whole mat 2. The mat 2 rests on a bed 3, or drainage stratum or strata, said drainage strata 3 resting in turn on a ground surface 4. The reference 5 illustrates drainage pipes arranged around the mat 2 in a manner known per se.

Beneath the mat 2 there is found in the bed or drainage stratum 3 a volume of air which, as experience has shown, normally has a humidity or degree of wetness of 100%, or only slightly therebelow. This means that the mat 2 will absorb moisture and obtains a high degree of wetness, even on its upper surface.

For the purpose of reducing the humidity of the air mass or volume 3', for example to a level of 90 or 70%, there is created beneath the bed 3 a mass of pressurized air, advantageously formed from air of low humidity, and preferably heated air. In the case of existing buildings, as shown in FIG. 1, where access to the bed 3 is more or less excluded, it is proposed in accordance with the invention that a hole **2*a* is drilled into the mat 2. This hole is preferably placed centrally of the mat. A fan 7 is connected to the hole, via a short pipe 8**. The hole can be made in the concrete mat in the vicinity of a wardrobe thereabove, and the fan placed in the corner of the wardrobe.

Figure 2:
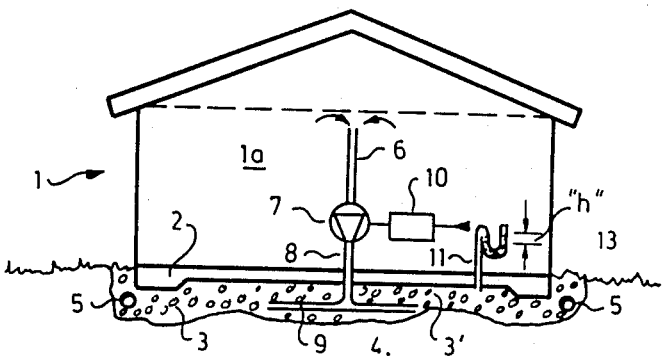
FIG. 2 is a sectional view of a newly erected small dwelling house, in which the foundations have been laid while observing the recommendations according to the present invention.

In the case of a building under erection, in accordance with FIG. 2, where full access can be had to the bed 3 prior to the mat being cast and the building erected on the mat, a system of pipes 9 can be placed in the bed 3 and connected to the pipe 8 and the fan 7.

In both these applications of the invention it is proposed that air is evacuated from the interior **1*a* of the building 1 and supplied through a pipe 6, with the aid of a fan 7 or like device, to the bed 3, 4 located beneath the mat 2. To this end, the fan 7 is arranged to cooperate with the pipe 8 which communicates with a pipe system 9 arranged in the bed 3. Evacuation air is supplied to the bed or the drainage stratum beneath the mat under pressure, and the mat 2 is intended to serve as a more or less air-tight cover, where the migration of air from the air mass 3' follows the mat 2 through the bed 3 and out to atmospheric air 13 around the sides of the mat 2**.

In order to enable the air mass 3' to be regulated with regard to air pressure and/or humidity, the fan 7 is arranged to co-act with a speed regulator 10, thereby enabling one and the same fan means to be used irrespective of varying ground conditions, and enabling the fan to be adapted to a pre-determined overpressure. The overpressure can be measured with the aid of a pipe 11 in the form of a U-tube partially filled with water or alcohol, where the distance "h" between the legs of the columns thus produced constitutes a measurement of the prevailing overpressure. This overpressure can be converted in a known manner and applied to the speed regulator, such as to slow the fan down when the pressure increases.

The overpressure in the air mass or volume 3' can be selected at such low magnitude that an overpressure of 6–7 Pascals can be expected to suffice in achieving the desired technical effect. In the case of a concrete mat whose surface area is beneath 150 $m^2$ a fan having a power output of 30 W is normally sufficient.

As will be understood, mats of larger surface area require higher overpressure.

Figure 3:
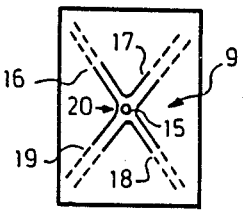
FIG. 3 illustrates one example of the positioning of pipes and/or hoses in the bed or drainage stratum with respect to the illustration of FIG. 2.

FIG. 3 illustrates an embodiment in which channels, hoses and/or pipes are arranged in the bed 3 beneath the mat 2 and connected to the aforesaid fans, said hoses or pipes optionally exhibiting one or more blow-locations beneath the mat 2.

A particular advantage is afforded when the channel forming hoses and/or pipes are perforated along the whole of their lengths or along a part thereof.

With regard to the fact that the pipes and/or hoses are positioned in the bed 3 so as to create an overpressure therein, the particular orientation of the pipes and/or hoses is selected in dependence upon the shape of the bed 3, its size and/or its air permeability. A particular advantage is afforded when the bed 3 upon which the mat is seated is highly permeable to air and enables satisfactory pressure distribution with but small pressure losses.

Suitably, the overpressure is selected at such high magnitude that the air mass or volume 3' will remain at overpressure even under changing climatic conditions.

As will be seen from FIG. 3, the pipes and/or hoses of this embodiment are placed in the bed 3 so as to form a "X" referenced 9, to the center point 15 of which air under pressure is supplied with the aid of the fan 7 coupled to the pipe 8. The pipe arrangement of this embodiment is provided with four blow-out locations 16, 17, 18 and 19 which open into blow-out locations facing towards the corners of the concrete mat. One blow-out location 20 is located centrally in relation to the mat 2. The blow-out locations can be drawn further out towards the corner parts of the mat, as indicated by the broken lines, and the positioning of these locations is dependent upon the nature of the ground material.

When the ground material is highly permeable to air, enabling pressure distribution with but small losses, fewer blow-out locations are required than when the ground material is less permeable. In this latter case the blow-out locations must be placed closer together. It is possible, in certain cases, to permit a pressure discrepancy between various blow-out locations, with a high overpressure in the centre of the arrangement.

Alternative embodiments of the pipe and/or hose orientation in the bed 3 include an "I" configuration and a "O" configuration. Air is also in this case supplied under pressure to a connecting location via the pipe 8.

Thus, the fan 7 blows part of the air evacuated from the building into the drainage stratum or bed 3, through the channel system 8, 9. The air forms in the bed an air mass or volume 3' under overpressure, beneath the mat 2, whereupon this overpressure is distributed partly throughout the bed 3 and partly through the ground 4 and out to atmosphere 13.

The fan 7 is connected to a speed regulator, which may also be adapted to varying resistances in the ground and bed. The amount of evacuated air supplied to the bed shall be adapted to the conditions prevailing in the ground structure and the floor structure.

The size of the fan 7 and its capacity are dependent upon the amount of air to be transported, the desired overpressure and the resistance offered by the ground and the bed.

The pipes and/or hoses of the illustrated channel system may be made of a plastics material or some other non-corroding material. In this respect, the manner in which the passages or channels are drawn is adapted to the structural design of the building, its form and function, while orientation beneath the ground in the bed 3 is determined in accordance with the positions of the blow-out locations and the number of such locations required. The number of blow-out locations provided depends upon ground conditions and the density of the flooring, and can therefore vary.

In the case of a dwelling house of normal size, less than 150 $m^2$, the number of blow-out locations provided is suitably between 1 and 5, normally between 1 and 3.

In the case of a mat intended for other types of buildings, for example a mat having a surface area of up to 1000 $m^2$, the number of blow-out locations is suitably from 1–10, preferably from 2–5.

The number of blow-out locations is primarily chosen with the view of bringing the wetness of the mat to a desired value. In this respect, each blow-out location is active over a given area which, at a given overpressure, is dependent upon the nature of the ground and the nature of the drainage stratum, although said active area will increase in size with increasing pressure. This therefore affords the possibility of making certain adjustments.

Figure 4:
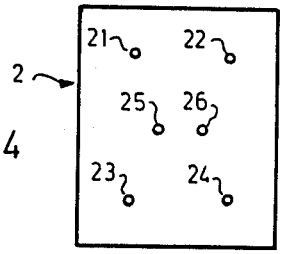
FIG. 4 illustrates an example of the positioning of air ejection locations in large buildings.

FIG. 4 illustrates an embodiment which incorporates a plurality of blow-out locations in large support mats 2. In this embodiment, blow-out locations 21, 22, 23 and 24 are placed along the edges of the mat, while blow-out locations 25 and 26 are placed in the centre thereof. Conveniently, the pressure at the blow-out locations 25 and 26 is somewhat higher than the pressure prevailing at remaining blow-out locations 21, 22, 23 and 24. The distance between the blow-out locations may vary from 10 to 50 meters, normally from 15 to 30 meters.

The bed 3 may comprise gravel, macadam, or shingle of good air permeability. In the case of the ground 4 being extremely dense or highly compacted, it may be necessary to increase the thickness of the bed in relation to what has previously been normal.

As beforementioned, the amount of air blown-in is adapted in a manner to obtain a given overpressure between the ground and the ambient air 13. The lowest requisite overpressure depends upon the structural design of the building, the ventilation system and the density of the ground and mat, and the desired reduction in moisture content, and also the desired degree of heating. The overpressure is suitably regulated so that an overpressure will constantly prevail in the bed 3, even when climatic conditions change.

In the case of large building structures, such as that illustrated in FIG. 4, it may be suitable under difficult moisture conditions to provide an air vent, preferably a regulatable air vent, through which air present in the air mass 3' can be released. This release of air can take place within the building, although it is preferably effected through channels and passages discharging to atmosphere.

For example, the blow-out locations 25 and 26 of the FIG. 4 embodiment can be replaced with air injection locations, or may serve as air-release channels.

As illustrated in FIG. 1, the invention can also be applied in existing building structures, in which case the fan be connected to pipes and/or hoses exclusively arranged within the building and/or within the floor structure, with the blow-out locations passing through the floor structure 2.

It also lies within the scope of the present invention to form a hole in the support mat, for example with a departure point from a wardrobe, and to connect a fan to the hole and force evacuated air under pressure into the underlying bed 3.

It will be understood that the invention is not restricted to the aforedescribed embodiments given by way of example, but that modifications can be made within the scope of the following claims defining the concept of the invention.

I claim:

1. A building arrangement comprising:

a stratum of porous material;

a foundation mat supported by said stratum;

a building structure supported on said foundation mat; and means for supplying air at a pressure above ambient pressure into said stratum so as to create an overpressure condition in said stratum whereby at least a portion of the supplied air escapes from said stratum to reduce water content in said stratum;

said means for supply air including a fan which is arranged to co-act with a speed regulator so that the fan is adapted to maintain a pre-determined amount of overpressure in said stratum, whereby the fan may be used effectively under differing ground conditions;

said fan receiving air from intake conduits arranged within the building structure, said fan supplying pressurized air through passages which extend through the foundation mat to air blow-out locations in said stratum.

2. A building arrangement comprising:

a stratum of porous material;

a foundation mat supported by said stratum;

a building structure supported on said foundation mat; and means for supplying air at a pressure above ambient pressure into said stratum so as to create an overpressure condition in said stratum, whereby at least a portion of the supplied air escapes from said stratum to reduce water content in said stratum, said means for supplying air under pressure utilizing air from the interior of the building.

3. The arrangement according to claim 2, wherein said means for supplying air includes a fan which is arranged to co-act with a speed regulator so that the fan is adapted to maintain a pre-determined amount of overpressure in said stratum, whereby the fan may be used effectively under differing ground conditions.

4. The arrangement according to claim 2, wherein said air supplying means includes a fan and conduits arranged in the stratum beneath said mat, said conduits being connected to said fan so as to receive pressurized air from said fan.

5. The arrangement according to claim 2, wherein said air supplying means includes a plurality of air blow-out locations arranged in the stratum beneath said mat.

6. The arrangement according to claim 2, wherein said air supplying means includes conduits disposed in the stratum beneath said mat, said conduits being perforated along at least a part of their lengths.

7. The arrangement according to claim 2, wherein the air permeability of the stratum beneath said mat is such as to enable pressure to be distributed with small pressure losses.

8. The arrangement according to claim 2, wherein said means for supplying air includes a hole formed in the foundation mat and a fan connected to said hole so as to supply pressurized air through said hole.

9. The arrangement according to claim 2, and further including means for evacuating part of the pressurized air from the stratum so as to be able to monitor the overpressure in the stratum.

10. The arrangement according to claim 2, wherein said stratum of porous material includes a drainage stratum.

11. The arangement according to claim 10, wherein a fan is arranged to coact with a speed regulator so that the fan is adapted to maintain a predetermined amount of overpressure in said stratum, whereby the fan may be used effectively under differing ground conditions.

12. The arrangement according to claim 10, wherein conduits are arranged in the stratum beneath said mat, said conduits being connected to said fan so as to receive pressurized air from said fan.

13. The arrangement according to claim 10, wherein said means for supplying air includes a plurality of air blowout locations arranged in the stratum beneath said mat.

14. The arrangement according to claim 10, wherein said air supplying means includes conduits disposed in the stratum beneath said mat, said conduits being perforated along at least a part of their lengths.

* * * * *